US007207651B2

(12) United States Patent
Amemiya

(10) Patent No.: US 7,207,651 B2
(45) Date of Patent: Apr. 24, 2007

(54) INKJET PRINTING APPARATUS

(75) Inventor: Isao Amemiya, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 228 days.

(21) Appl. No.: 10/809,414

(22) Filed: Mar. 26, 2004

(65) Prior Publication Data

US 2004/0189748 A1 Sep. 30, 2004

(30) Foreign Application Priority Data

Mar. 28, 2003 (JP) ..... 2003-090182

(51) Int. Cl.
*B41J 2/135* (2006.01)

(52) U.S. Cl. ..... 347/46; 347/74; 347/77; 347/82

(58) Field of Classification Search ..... 347/46
See application file for complete search history.

(56) References Cited

U.S. PATENT DOCUMENTS

| | | | | |
|---|---|---|---|---|
| 4,308,547 | A | 12/1981 | Lovelady et al. | |
| 6,036,301 | A | 3/2000 | Amemiya et al. | |
| 6,045,208 | A | 4/2000 | Hirahara et al. | |
| 6,123,412 | A | 9/2000 | Yamamoto et al. | |
| 6,497,510 | B1 * | 12/2002 | Delametter et al. | 347/74 |
| 6,866,370 | B2 * | 3/2005 | Jeanmaire | 347/77 |

FOREIGN PATENT DOCUMENTS

| | | |
|---|---|---|
| JP | 09-248913 | 9/1997 |
| JP | 9-290504 | 11/1997 |
| JP | 11-77994 | 3/1999 |

OTHER PUBLICATIONS

Krause, K. A., "Focusing Ink Jet Head", IBM Technical Disclosure Bulletin, vol. 16, No. 4, p. 1168, Sep. 1973.
Notification of Reason for Rejection issued by the Japanese Patent Office, dated Sep. 1, 2005, for Japanese Patent Application No. 2003-090182, and English-language translation thereof.

* cited by examiner

*Primary Examiner*—Stephen Meier
*Assistant Examiner*—Brian J. Goldberg
(74) *Attorney, Agent, or Firm*—Finnegan, Henderson, Farabow, Garrett & Dunner, L.L.P.

(57) ABSTRACT

An acoustic inkjet printing apparatus focusing acoustic waves generated by transducers and ejecting droplets of a printing liquid from a surface thereof by means of a sound pressure of the acoustic wave, the acoustic inkjet printing apparatus comprising: a printing liquid containing chamber containing the printing liquid; a piezoelectric element including a main transducer and at least one sub transducer located on at least one side of the main transducer, and generating the acoustic wave by receiving a signal; and an acoustic focusing member focusing the acoustic wave generated by the piezoelectric element near the surface of the printing liquid, thereby ejecting the droplets of the printing liquid, the acoustic inkjet printing apparatus being capable of switching between a first ejection mode in which the droplets are ejected in a first direction perpendicular to a liquid surface in the printing liquid containing chamber and a second ejection mode in which the droplets are ejected at an angle to the first direction by applying or not applying a drive signal to the sub transducer in accordance with image printing data, while the drive signal is being applied to the main transducer of the piezoelectric element.

18 Claims, 12 Drawing Sheets

(1) BURST WAVE (WITH CONSTANT VOLTAGE)

(2) TONE-BURST WAVE (3) AMPLITUDE MODULATION BURST WAVE (4) AMPLITUDE MODULATION TONE-BURST WAVE

INKJET PRINTING APPARATUS

CROSS-REFERENCE TO RELATED APPLICATIONS

This application is based upon and claims the benefit of priority from prior Japanese Patent Application No. 2003-090182, filed on Mar. 28, 2003, the entire contents of which are incorporated herein by reference.

BACKGROUND OF THE INVENTION

1. Field of the Invention

The present invention relates to an inkjet printing apparatus, which prints images by splitting a liquid material into droplets that are ejected to a print media, and a method of recovering a liquid material. In particular, the present invention relates to an inkjet printing apparatus, which continuously ejects droplets by means of the pressure of focused ultrasonic waves emitted from transducers, and a method of recovering a liquid material.

2. Related Art

Inkjet printing apparatuses, which eject liquid droplets toward print media to form printing dots, have such advantageous effects that less noise is produced as compared to other printing systems, and that it is not necessary to perform developing treatment and fixing treatment. Accordingly, inkjet printing apparatuses are widely used in the field of plain paper printing technology. Having such characteristic features that non-contact recording is possible, that printing can be performed with a minimum of materials consumed, and that it is possible to manufacture such apparatuses at a low cost, etc., the inkjet apparatuses are used beyond the conventional field of printing, i.e., printing images to paper media, and are applied to an industrial process field such as the coating of liquid electronic material, direct patterning, etc. In the fields of industrial process and industrial printing, the most important requirement is a high-speed throughput. In order to achieve this requirement, a high-speed droplet ejecting frequency, a highly dense positioning of nozzles, and high ejection reliability are required.

At present, various types of inkjet printing apparatuses have been proposed, of which representative examples are one that ejects droplets by means of the pressure of steam generated by heat from a heating element, and one that ejects droplets by means of pressure pulses caused by the displacement of a piezoelectric material.

In these types of inkjet printing apparatuses, droplets are ejected from a nozzle disposed at the end of a pressure chamber, which contains a printing liquid, by means of changes in pressure inside the pressure chamber. Such inkjet printing apparatuses are in actual use as so-called "on-demand type" inkjet printing apparatuses, which eject droplets in accordance with image printing information. However, in such on-demand type inkjet printing apparatuses utilizing wholly changes in pressure in the pressure chambers, there is a problem in that when droplets are ejected, the meniscus at the liquid surface, from which droplets are ejected, falls back, and a certain period of time is required for the meniscus to return to the original position by the refilling of the printing liquid from a printing liquid tank, resulting in that it is difficult to eject droplets at a high frequency. Furthermore, the adverse effect of vibrations remaining in the printing liquid pressure chamber makes it difficult to perform continuous ejections at a high speed. As a result, when droplets are intended to be continuously ejected at a high frequency, the ejections become unstable and certain phenomena may occur, such as no droplet being ejected, extra satellites (sub-droplets) being ejected, etc.

Although an on-demand type inkjet printing apparatus ejects droplets for the printing of an image upon receiving image printing information, there is another type of inkjet printing apparatus, i.e., so-called a "continuous type (continuous ejection type)" inkjet printing apparatus, which continuously ejects droplets but changes the flying directions of droplets upon receiving image printing information. This type of inkjet printing apparatus has a characteristic feature that high-speed printing is possible. A charge-control inkjet printing apparatus, which is a typical apparatus of the continuous type, includes a charged electrode which selectively charges droplets in front of the nozzle in accordance with image printing information, and a deflection electrode which deflects the flying direction of ejected droplets passing through it by an electric field. Although such a continuous type inkjet printing apparatus can continuously eject droplets at a high frequency, the structure thereof is complicated and a high voltage is required in order to operate it. Accordingly, it is difficult to densely position nozzles, and there is a limitation on the properties of printing liquid.

Another type of inkjet printing apparatus, i.e., an ultrasound inkjet printing apparatus, has also been proposed, which focuses ultrasound waves generated by a transducer in order to eject droplets from a surface of a printing liquid by means of the acoustic pressure of the ultrasound waves. Since such an inkjet printing apparatus is of a "nozzleless" type, which does not require nozzles each corresponding to individual dot, nor needs a partition wall for dividing printing liquid paths, it can effectively prevent the clogging and eliminate the step of recovering from the clogging, which have been an obstacle to the production of a "line head type" inkjet apparatus. Furthermore, since it is possible for this type of inkjet printing apparatuses to stably eject very minute droplets, they are suitable for improving resolution. Moreover, there is little limitation on printing liquid material used in this type of printing apparatus since the size of droplets is dependent on the wavelength of ultrasound waves. There is a problem, however, in that it is difficult for this type of printing apparatus to eject droplets at a high frequency since it is difficult for this type of printing apparatus to generate a power to pull back the meniscus formed at the liquid surface at a high speed after the ejection of droplets.

There is an ultrasound inkjet printing apparatus of continuous type, which ejects droplets by means of focused ultrasound beams, as disclosed in Japanese Patent Laid-Open Publication No. 248913/1997 (pages 2–5, FIG. 1). However, like the aforementioned continuous type charge-control inkjet printing apparatus, an inkjet printing apparatus of this kind becomes rather large due to the use of an electric field to control the courses of ejected droplets. In addition, in order to prevent the interference of electric field between adjacent droplet ejection portions, it is not possible for this type of inkjet printing apparatus to densely position droplet ejection portions.

There is an ultrasound inkjet printing apparatus of the on-demand type, which ejects droplets of printing liquid in multiple directions by combining a plurality of transducers generating ultrasound waves, as shown in U.S. Pat. No. 4,308,547. However, an inkjet printing apparatus of this kind has a problem in that the acoustic pressures of ultrasound beams focused on the liquid surface tend to vary depending on the directions of ejected droplets, thereby varying the sizes of droplets, resulting in that it is difficult for this type of inkjet printing apparatus to eject droplets in a stable manner.

SUMMARY OF THE INVENTION

The present invention is proposed to solve the aforementioned problems, and it is an object of the present invention to provide an acoustic inkjet printing apparatus of the continuous type, which can improve the droplet ejection efficiency and the repetitive ejection frequency, and have a highly densely structured head.

An acoustic inkjet printing apparatus focusing acoustic waves generated by transducers and ejecting droplets of a printing liquid from a surface thereof by means of a sound pressure of the acoustic wave, the acoustic inkjet printing apparatus comprising: a printing liquid containing chamber containing the printing liquid; a piezoelectric element including a main transducer and at least one sub transducer located on at least one side of the main transducer, and generating the acoustic wave by receiving a signal; and an acoustic focusing member focusing the acoustic wave generated by the piezoelectric element near the surface of the printing liquid, thereby ejecting the droplets of the printing liquid, the acoustic inkjet printing apparatus being capable of switching between a first ejection mode in which the droplets are ejected in a first direction perpendicular to a liquid surface in the printing liquid containing chamber and a second ejection mode in which the droplets are ejected at an angle to the first direction by applying or not applying a drive signal to the sub transducer in accordance with image printing data, while the drive signal is being applied to the main transducer of the piezoelectric element.

An acoustic inkjet printing apparatus focusing acoustic waves generated by transducers and ejecting droplets of a printing liquid from a surface thereof by means of a sound pressure of the acoustic wave, the acoustic inkjet printing apparatus including a plurality of printing liquid ejecting units arranged in a matrix form, the units in adjacent lines being shifted from each other, each unit comprising: a printing liquid containing chamber containing the printing liquid; a piezoelectric element including a main transducer and at least one transducer located on at least one side of the main transducer, and generating the ultrasound wave by receiving a signal; and an acoustic focusing member focusing the acoustic waves generated by the piezoelectric element near the surface of the printing liquid, thereby ejecting the droplets of the printing liquid, the acoustic inkjet printing apparatus being capable of switching between a first ejection mode in which the droplets are ejected in a first direction perpendicular to a liquid surface in the printing liquid containing chamber and a second ejection mode in which the droplets are ejected at an angle to the first direction by applying or not applying a drive signal to the sub transducer in accordance with image printing data, while the drive signal is being applied to the main transducer of the piezoelectric element.

A method of ejecting and recovering a printing liquid by focusing acoustic waves generated by transducers, ejecting droplets of the printing liquid contained in a printing liquid containing chamber from a surface thereof by means of a sound pressure of the acoustic wave, and recovering the droplets, wherein the droplets are ejected in a straight manner so as to pass through an opening of a droplet recovery member by applying or not applying a drive signal to a sub transducer located adjacent to a main transducer of a piezoelectric element in accordance with image printing data, and the droplets are ejected in a deflecting manner so as to hit a droplet recovery surface of the droplet recovery member by applying or not applying the drive signal to the sub transducer, while the drive signal is being applied to the main transducer.

DESCRIPTION OF THE EMBODIMENTS

Hereinafter, inkjet printing apparatuses according to embodiments of the present invention will be described in detail with reference to the accompanying drawings. It should be noted that the present invention is not limited to these embodiments.

(First Embodiment)

First, an inkjet printing apparatus according to a first embodiment of the present invention will be described. The inkjet printing apparatus of this embodiment includes a very densely structured head portion, and is capable of improving droplet ejection efficiency and repetitive ejection frequency. Such features of the present invention can be achieved by generating ultrasound waves in phase with each other, and by substantially equalizing the size of droplets used for printing and the size of droplets not used for printing.

Figure 1:
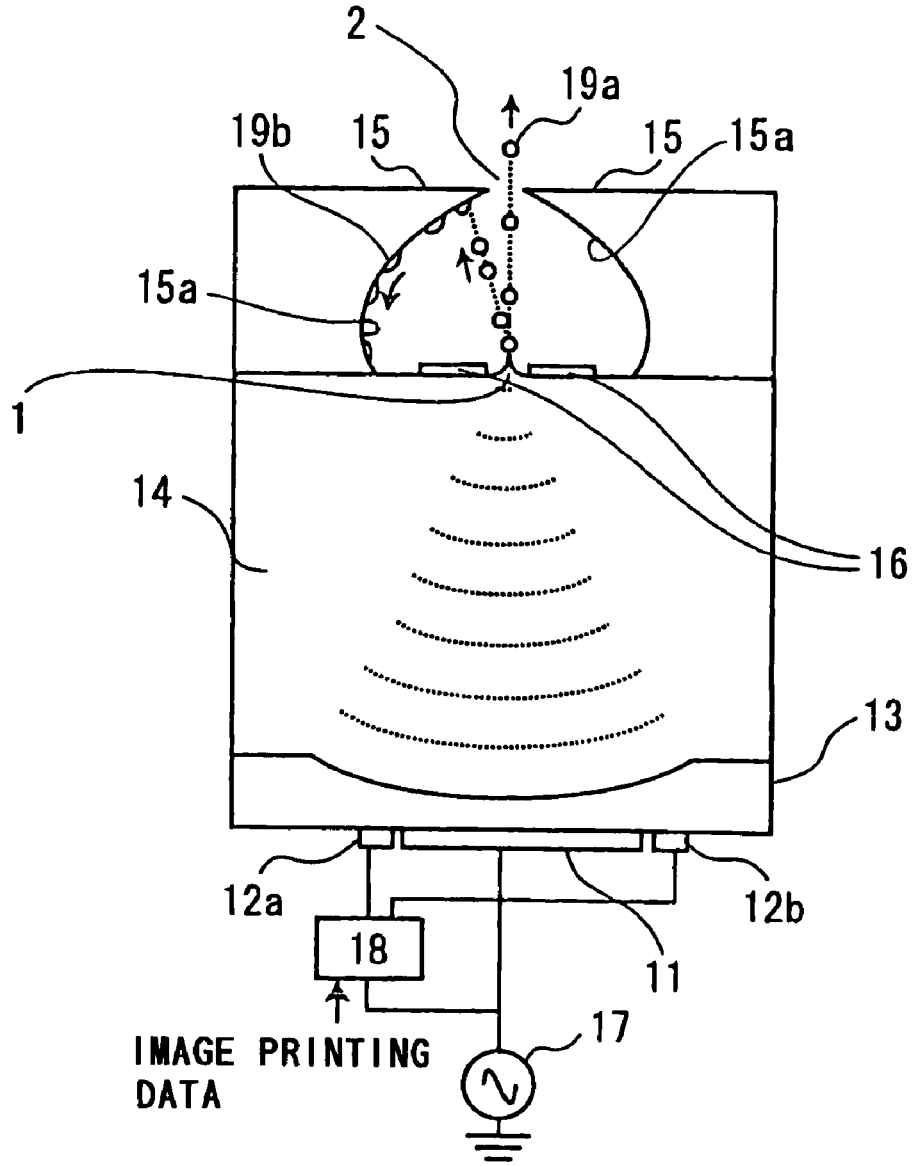
FIG. 1 is a sectional view showing a head portion of an inkjet printing apparatus of continuous type according to the first embodiment of the present invention.

FIG. 1 is a sectional view showing a head portion of a continuous type ultrasound inkjet printing apparatus according to this embodiment.

As shown in FIG. 1, a main transducer 11 serving as an ultrasound wave generating means and two sub transducers 12*a* and 12*b* provided at both sides of the main transducer 11 are connected to a flat portion of an acoustic lens 13 having a plano-concave shape, and serving as an acoustic wave focusing means, a spherical aberration of the acoustic lens 13 being corrected. A concave side of the acoustic lens 13 contacts a bottom surface of a printing liquid containing chamber 14. In FIG. 1, only a part of the printing liquid containing chamber 14 is shown. A droplet recovery plate (droplet recovery member) 15 is provided in an upper portion of the printing liquid containing chamber 14. The droplet recovery plate 15 is a plate-shape member located on the surface of the printing liquid contained in the printing liquid containing chamber 14, and has a through-hole extending from a liquid surface opening 1 to an upper opening 2. The through-hole is for recovering droplets ejected from the printing liquid containing chamber 14 but are not used to print an image. The angle formed in the vicinity of the upper opening 2 between the upper surface of the droplet recovery plate 15 and an internal surface 15*a*, 15*a* of the through-hole is an acute angle. The internal surface 15*a*, 15*a* corresponds to a curved droplet recovery surface. A liquid surface control plate 16 having a circular shape with an opening at the central portion thereof (i.e., ring shape), for keeping the liquid surface at a constant level, and for protecting the liquid surface from an influence of disturbances, is provided in an area of the liquid surface of the printing liquid containing chamber 14 where droplets are ejected.

In this embodiment, the acoustic lens 13, which has a plano-concave shape, and the spherical aberration of which is corrected, is used as the acoustic wave focusing means. Since the acoustic lens 13 has a flat surface at one side, it is possible to easily form and fix the transducers thereon, and since the spherical aberration of the acoustic lens 13 is corrected, it is possible to accurately align the phases of the ultrasound waves emitted from the transducers at the flat surface side at a predetermined focal point near the surface of the printing liquid. The "spherical aberration" herein means a problem that in the case where the concave portion is a simple spherical shape, the refraction of acoustic waves becomes greater in the peripheral portion of the lens than in the central portion, thereby causing a phase shift at the focal point. This problem can be solved by "spherical aberration correction", meaning that the concave portion of the acoustic lens is re-shaped into an aspherical shape, which can be represented by a higher order function, in consideration of the effect of refraction. It should be noted that a Fresnel lens does not involve a problem of refraction in a peripheral portion as in the case of the aforementioned plano-concave lens, because a Fresnel lens has a flat shape.

In this embodiment, the main transducer 11 and the sub transducers 12*a* and 12*b* are connected to a common drive signal generating source (drive signal generating means) 17. A selector 18 serving as a drive signal controlling means for determining whether or not the transducers should be driven in according with image printing information is connected between the sub transducers 12*a* and 12*b* and the drive signal generating source 17. As a result, the main transducer 11 is always driven by the drive signal generating source 17, and the sub transducers 12*a* and 12*b* are driven upon receiving a drive signal from the selector 18. The ultrasound waves generated by driving the main transducer 11 and the sub transducers 12*a* and 12*b* are transmitted via the acoustic lens 13 into the printing liquid contained in the printing liquid containing chamber 14, and focused at a point on the liquid surface surrounded by the liquid surface control plate 16. A meniscus is formed on the liquid surface due to the pressure from the focused acoustic beam, and a droplet is separated from the liquid surface and ejected. Since the main transducer 11 and the sub transducers 12*a* and 12*b* are connected to the common driving signal generating source 17, it is possible to align the phases thereof as if only one transducer were used, thereby efficiently focusing the acoustic waves.

Furthermore, in this embodiment, there are a first ejection mode for ejecting droplets in a direction perpendicular to the liquid surface in the printing liquid containing chamber 14, and a second ejection mode for ejecting droplets at an angle to the perpendicular direction. In FIG. 1, the center of the area including the main transducer 11 and the sub transducers 12*a* coincides with the center of the acoustic lens 13. Furthermore, the focal point of the acoustic lens 13 is in the opening at the center of the liquid surface control plate 16 located on the liquid surface in the printing liquid containing chamber 14. In the first ejection mode, the main transducer 11 and the sub transducer 12*a* are simultaneously driven, thereby focusing acoustic waves symmetrically with respect to the droplet ejection point, thereby ejecting a droplet 19*a* in a direction perpendicular to the liquid surface. The droplet 19*a* moves straight toward the upper opening 2 of the droplet recovery plate 15, passes therethrough, and flies toward a print media. The acoustic wave emission area of the sub transducer 12*b* is substantially the same as that of the sub transducer 12*a*, and these two transducers are symmetrically located relative to the main transducer 11. The "acoustic wave emission area" herein means the area sandwiched by a pair of electrodes formed on opposite surfaces of a piezoelectric member. In the second ejection mode, the sub transducer 12*a* is not driven, but the main transducer 11 and the sub transducer 12*b* are simultaneously driven, thereby changing the distribution of the acoustic wave beam to the right in the drawing, thereby deflecting the direction in which a droplet 19*b* is ejected to the left relative to the direction perpendicular to the surface of the printing liquid contained in the printing liquid containing chamber 14. The droplet 19*b* ejected at an angle hits the internal surface of the droplet recovery plate 15, slides down the circularly curved internal surface in accordance with the force of gravity, and returns to the surface of the printing liquid contained in the printing liquid containing chamber 14.

Since the acoustic wave emission areas of the sub transducers 12*a* and 12*b* are substantially identical with each other, it is possible to change the acoustic pressure distribution (direction of focused acoustic wave beam) with the acoustic pressure level at the liquid surface being kept constant in the two ejection modes. Accordingly, it is possible to make the sizes of the droplets 19*a* and 19*b* substantially identical with each other. That is to say, it is possible to change the droplet ejection direction without considerably changing the states of meniscus formed at the liquid surface in any of the two ejection modes.

As described above, in the inkjet printing apparatus of this embodiment, since the main transducer 11 and the sub transducers 12*a* and 12*b* are connected to the common drive signal generating source 17, it is possible to align the phases of these transducers when they start vibrating. Furthermore, since a concave lens with its spherical aberration being corrected or a Fresnel lens is used as the acoustic lens 13, the phases of the transducers can be aligned. Accordingly, if the droplet ejection direction is changed in accordance with image printing information, the state of meniscus formed at the liquid surface is not considerably changed. Thus, it is possible for this continuous type ultrasound inkjet printing apparatus to stably supply droplets. Furthermore, since the acoustic wave emission areas of the sub transducers 12*a* and 12*b* are substantially identical with each other, it is possible to keep the acoustic pressure level substantially constant, and it is possible to further stably supply ink droplets for the reason identical with that for the case where the phases are aligned.

Next, each part of the head will be described in more detail below.

Figure 2:
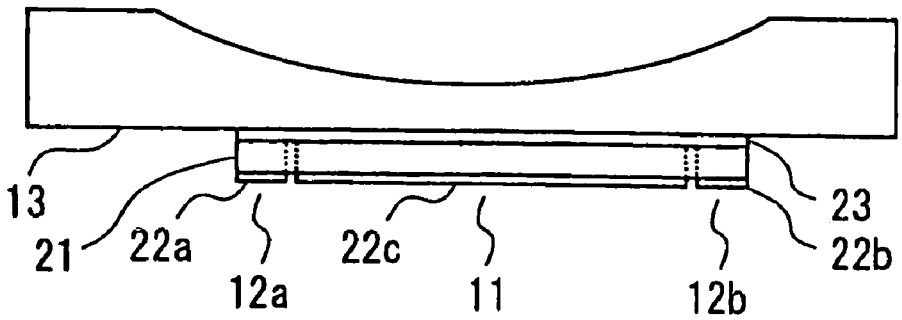
FIG. 2 is a sectional view of the inkjet printing apparatus according to the first embodiment of the present invention equipped with another type of transducer.

Each of the main transducer 11 and the sub transducers 12*a* and 12*b* is a piezoelectric device including a piezoelectric member and electrodes sandwiching the piezoelectric member. Piezoelectric ceramics such as lead zirconate titanate (PZT), lead titanate, barium titanate, etc., piezoelectric single crystals such as lithium niobate, lithium tantalite, etc., piezoelectric polymers such as polyvinylindene fluoride (PVDF), etc., and piezoelectric semiconductors such as zinc oxide, etc., can be used as the material of the piezoelectric member. The transducers in FIG. 1 are physically formed separately, and although the sectional views of the transducers in FIG. 1 do not show the details, a piezoelectric member is sandwiched by electrodes in each transducer. However, as shown in FIG. 2, a single piezoelectric member 21, separate electrodes 22*a*, 22*b*, 22*c* each having a predetermined shape, and a common electrode 23 can be combined to form the main transducer and the sub transducers. In this case, the region where the separate electrode 22*a* is formed corresponds to the sub transducer 12*a*, the region where the separate electrode 22*c* is formed corresponds to the main transducer 11, and the region where the separate electrode 22*b* is formed corresponds to the sub transducer 12*b*. Such a structure to form only electrodes separately is advantageous in the formation of minute transducers used for high resolution printing since no mechanical process is necessary, thereby facilitating the manufacture of such transducers. Further, this structure is efficient since part of the piezoelectric member where no electrode is formed can be vibrated due to the diffraction effect of the electric field.

Figure 3:
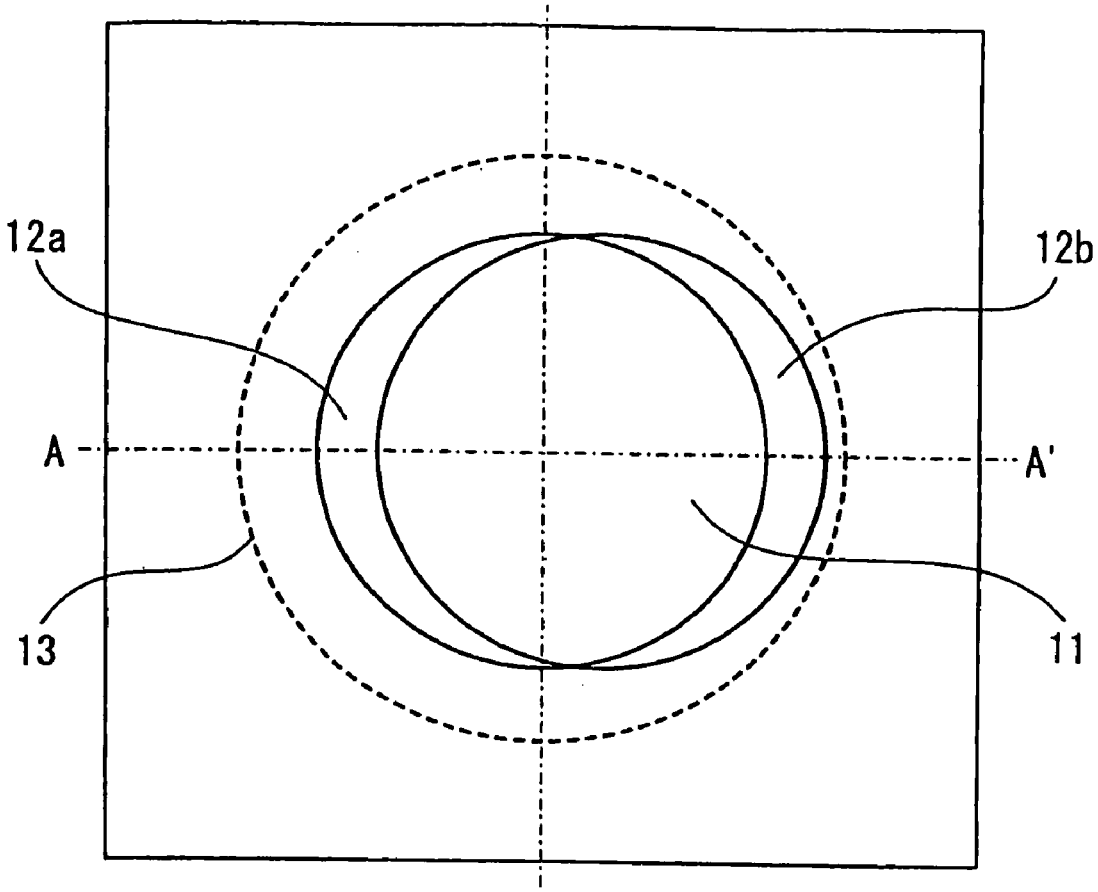
FIG. 3 is a plan view showing the relative location of an acoustic lens and transducers of the inkjet printing apparatus according to the first embodiment of the present invention.

FIG. 3 is a plan view showing the shapes of the transducers and the locations thereof relative to the acoustic lens 13. The acoustic wave emission areas of the sub transducers 12*a* and 12*b* are in a crescent shape, are smaller than that of the main transducer 11, and are located at both sides of the main transducer 11 so as to be symmetrical to each other. A combination of the main transducer 11 and one of the sub transducers 12*a* and 12*b* makes a substantially circular shape. The acoustic wave emission area of the combination of the main transducer 11 and the sub transducer 12*a* is substantially the same as that of the combination of the main transducer 11 and the sub transducer 12*b*. Furthermore, the center of the circular acoustic wave emission region of the combination of the main transducer 11 and the sub transducer 12*a* in the first ejection mode for ejecting droplets in a direction perpendicular to the surface of printing liquid contained in the printing liquid containing chamber 14 coincides with the center of the acoustic lens 13. Accordingly, the emitted acoustic waves are focused with a symmetrical distribution with respect to the central axis of the lens, thereby ejecting droplets in a direction perpendicular to the liquid surface. On the other hand, the sub transducer 12*b* is disposed such that the center of the circular acoustic wave emission region of the combination of the main transducer 11 and the sub transducer 12*b* is transversely shifted from the center of the acoustic lens 13. Accordingly, the central axis of the focused ultrasound beam is at an angle with the liquid surface, resulting in that the droplets are ejected in an inclined direction. It should be noted, however, that the shapes of the transducers are not limited to those (lune) shown in FIG. 3, but can be any shapes as long as the main transducer 11 is sandwiched by the two sub transducers 12*a* and 12*b*. It is preferable that the shapes of the combination of the main transducer 11 and the sub transducer 12*a*, and the combination of the main transducer 11 and the sub transducer 12*b*, are circular or oval since it is preferable that the shape (distribution) of the generated ultrasound beams is symmetrical with respect to the central axis thereof in order to efficiently form a stable meniscus and to prevent the generation of satellite droplets (sub droplets). Furthermore, it is preferable that the shapes of the sub transducers 12*a* and 12*b* are crescent or shapes similar to crescent obtained by cutting a part of a circle since it is preferable that the shape of the ultrasound beams is symmetrical.

Figure 4:
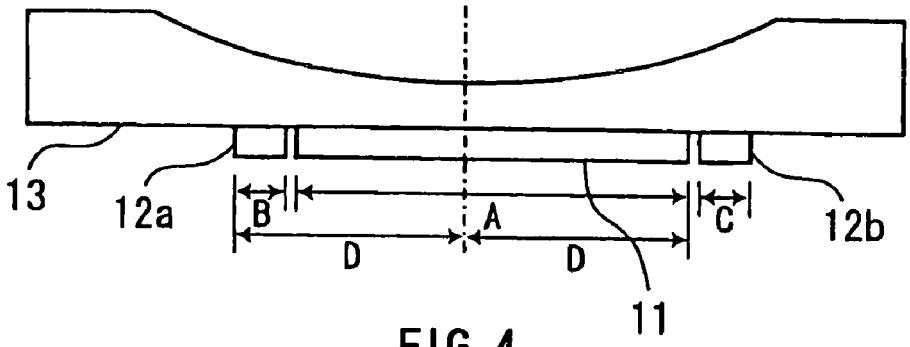
FIG. 4 is a sectional view taken along line A–A' of FIG. 3.

FIG. 4 is a sectional view taken along line A–A' of FIG. 3. As described above, both the distance between the center of the acoustic lens 13 and the end of the sub transducer 12*a* and the distance between the center of the acoustic lens 13 and the end of the acoustic lens 13 at the side of the sub transducer 12*b* are adjusted to be "D", and the width of the sub transducers 12*a* and 12*b* is smaller than that of the main transducer 11. Furthermore, a combined width of (A+B) of the main transducer 11 and the sub transducer 12*a* is substantially identical with a combined width (A+C) of the main transducer 11 and the sub transducer 12*b*. Preferably, in the case where a droplet is ejected in the second ejection mode at an angle of θ with respect to the perpendicular direction, if the width (A+C) is set to satisfy $(A+B)\cdot\cos\theta \leqq (A+C) \leqq (A+B)$, the focused acoustic pressures and the beam widths in the first and second ejection modes become substantially the same, whereby it is possible to change only the droplet ejection direction without considerably changing the state of meniscus formed at the liquid surface.

Figure 5:
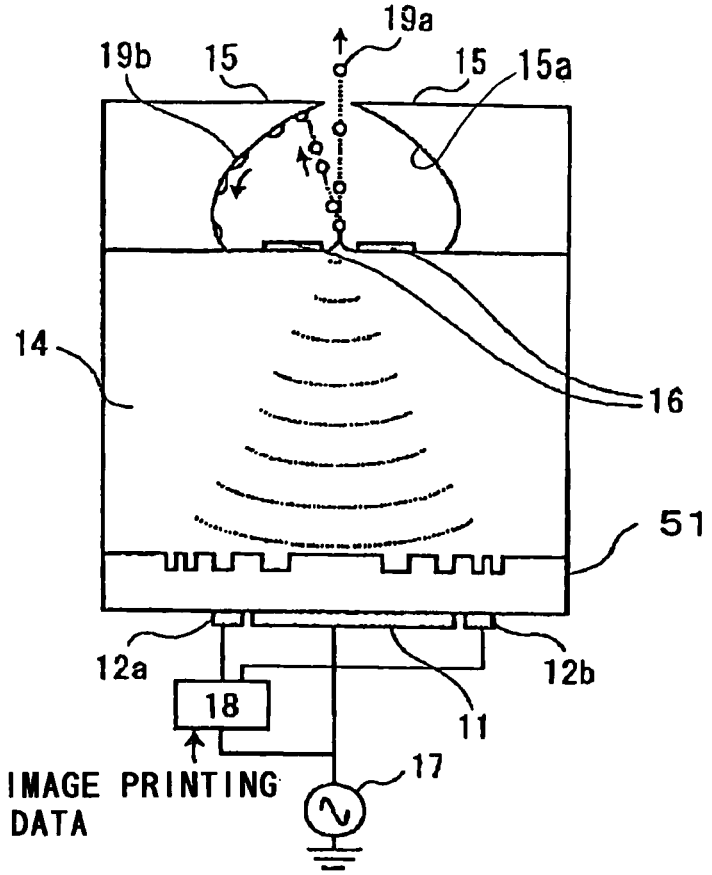
FIG. 5 is a sectional view of the inkjet printing apparatus according to the first embodiment of the present invention equipped with another type of acoustic lens.

A material highly durable against chemicals such as a printing liquid, e.g., an inorganic material such as glass, etc., and an epoxy resin, or a glass or resin the surface of which is coated with a material highly durable against a printing liquid, such as a metal layer, a metal oxide layer, a nitride layer, a polyolefin resin layer, etc., is used as a material of the acoustic lens 13. In FIG. 1, the concave portion of the acoustic lens 13 is illustrated to have a curved surface having a simple curvature. However, actually, an aspheric lens is used, the spherical aberration of which, caused by refraction, has been corrected. Furthermore, it is preferable that an acoustic impedance of the acoustic lens 13 is an intermediate value between an acoustic impedance (ZP) of the piezoelectric member and an acoustic impedance (ZL) of the printing liquid, which is dose to a geometric average $(ZP \cdot ZL)^{1/2}$ thereof in order to efficiently propagate acoustic waves. In addition, although the use of a plano-concave lens is shown in FIG. 1, a plane (Fresnel) lens 51 according to the Fresnel's zone theory as shown in FIG. 5 can be used. The F-number (=focal length/aperture) of the acoustic lens of this embodiment is set to be about 1. In order to eject droplets at a high speed with droplet ejection directions being switched, it is preferable that the region where the ultrasound beams emitted in the first and second ejection modes overlap each other, i.e., the region, which always receives acoustic waves, is as large as possible. In other words, it is preferable that a greater change in ejection direction be created by switching the sub transducers 12*a* and 12*b* having a smaller area. In order to make the widths of the sub transducers 12*a* and 12*b* considerably smaller than that of the main transducer 11, and to realize a change in ejection direction at an angle of 10 degrees or more, it is preferable that the acoustic lens 13 is a lens having a shorter focal length with a F-number of 2 or less. Furthermore, it is preferable that the focal point of the acoustic lens 13 is set to be a little higher than the liquid surface at a stationary state, i.e., at a position around the apex of meniscus formed at the time of ejecting droplets, thereby enabling a droplet ejection at a higher speed with a lower energy.

Figure 6:
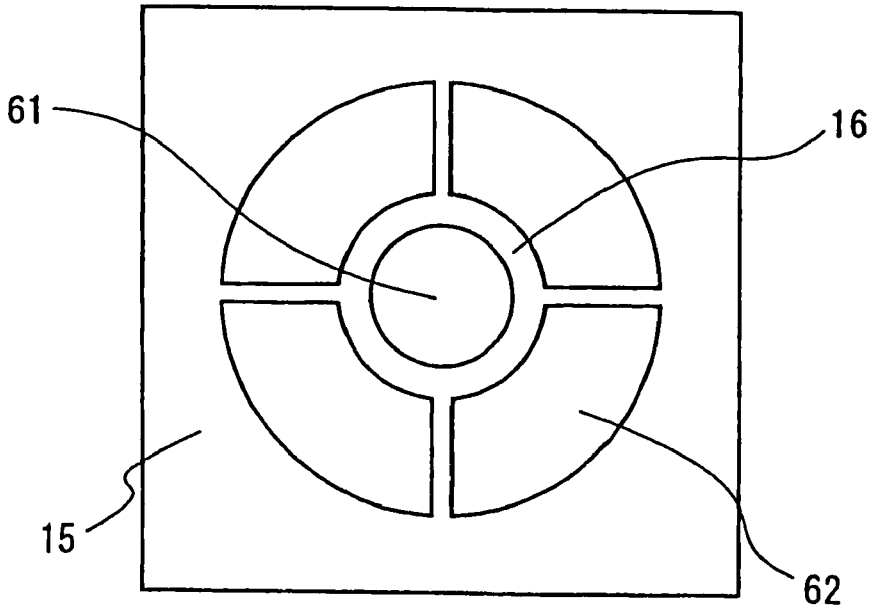
FIG. 6 is a plan view showing a liquid surface control plate of the inkjet printing apparatus according to the first embodiment of the present invention.

FIG. 6 is a plan view showing the liquid surface control plate 16 viewed from an upper portion of FIG. 1. The liquid surface control plate 16 having a circular opening is located so as to surround a liquid surface region 61 where a meniscus is formed, at the apex of which a droplet is ejected. Bridges extending in four directions to the droplet recovery plate 15 support the liquid surface control plate 16. A recovery region 62 where ejected printing liquid droplets that are not used for printing are recovered and sent to the printing liquid containing chamber 14 via the droplet recovery plate 15 exists around the liquid surface control plate 16. The liquid surface control plate 16 has an effect of not conveying vibrations of the liquid surface caused by the recovered droplets moving back to the printing liquid containing chamber. Furthermore, the liquid surface control plate 16 serves to stabilize the movement of meniscus by the use of the surface tension. It is preferable that a non-wet coating for water (or oil) is applied to the surface of the liquid surface control plate 16, thereby preventing the adhesion of unnecessary printing liquid, resulting in that a stable generation of surface tension can always be realized. The material of the liquid surface control plate 16 can be a rigid metal or resin.

Figure 7:
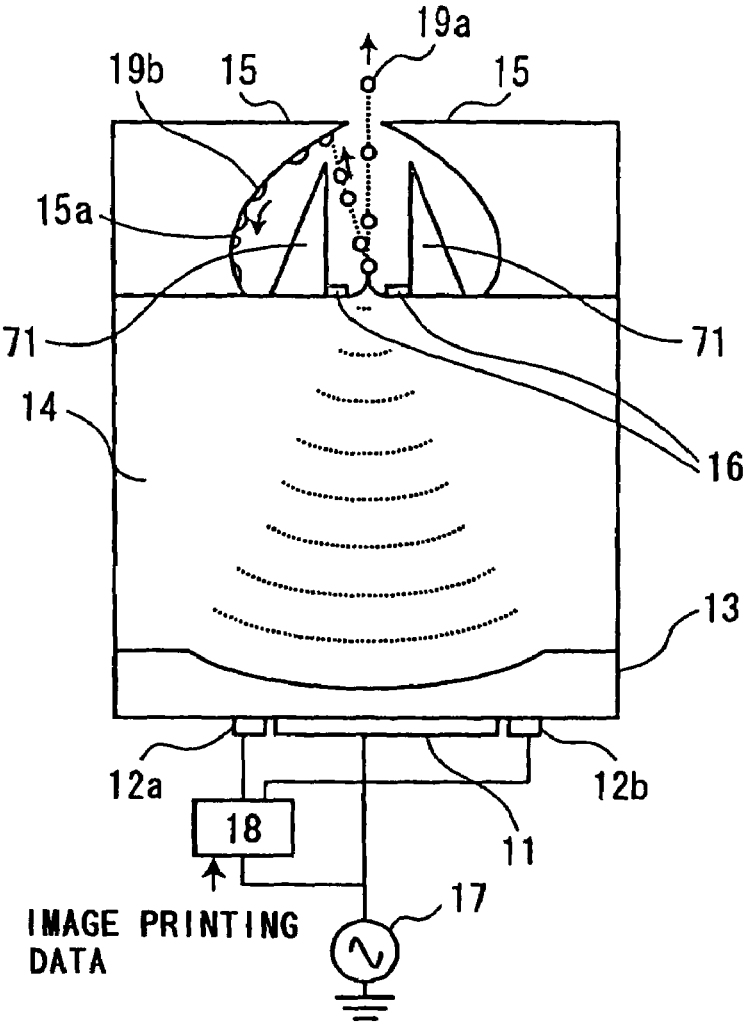
FIG. 7 is a sectional view of the inkjet printing apparatus according to the first embodiment of the present invention equipped with another type of droplet recovery plate.
Figure 8:
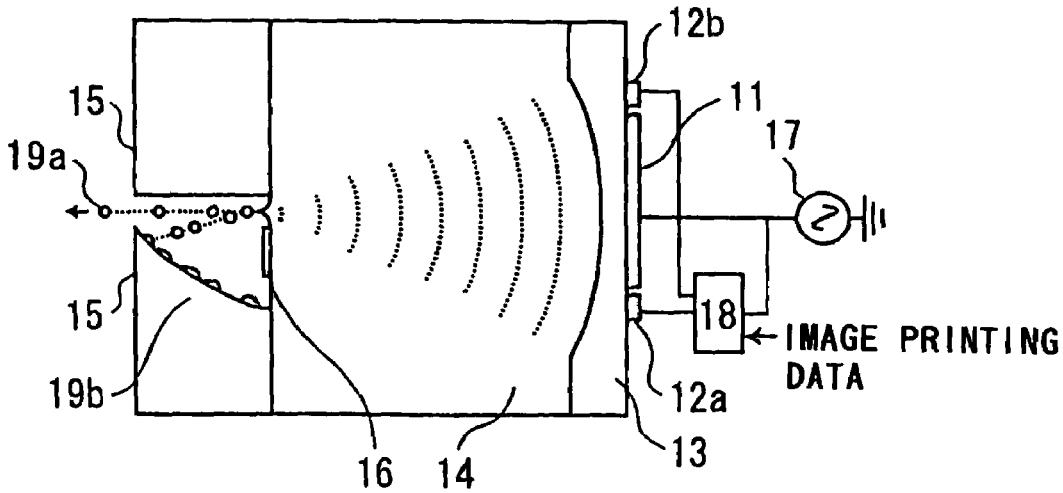
FIG. 8 is a sectional view of the inkjet printing apparatus according to the first embodiment of the present invention equipped with still another type of droplet recovery plate.
Figure 9:
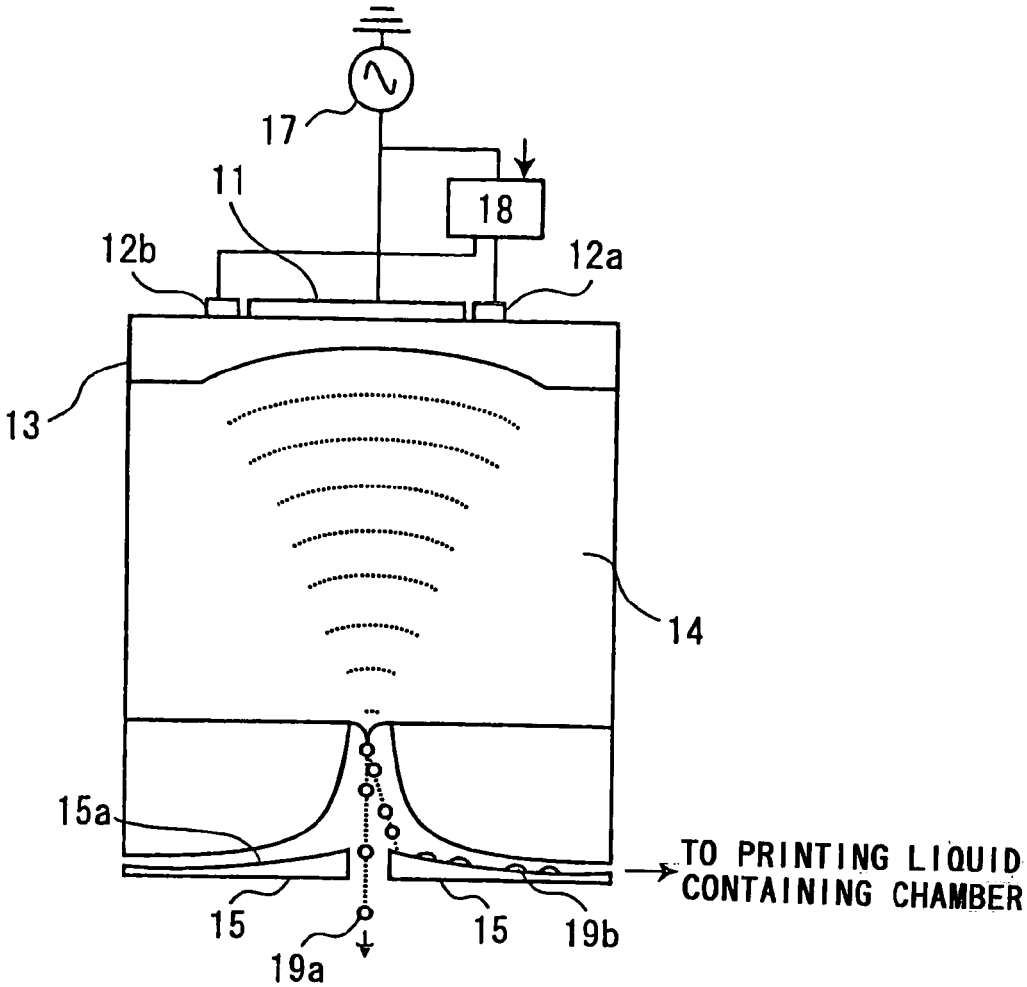
FIG. 9 is a sectional view of the inkjet printing apparatus according to the first embodiment of the present invention equipped with yet another type of droplet recovery plate.

As shown in FIG. 1, the droplet recovery plate 15 has a through-hole extending from the liquid surface opening 1 in the vicinity of the droplet ejection portion to the upper opening 2. The through-hole has an internal surface in a shape of a reversed bowl. Since the droplets not to be used for printing are ejected in an inclined direction relative to the liquid surface, such droplets hit the internal surface of the droplet recovery plate 15, and move downwards along the internal surface to the liquid surface of the printing liquid containing chamber 14 directly below the hit point. Accordingly, when a high-frequency continuous droplet ejection is performed, which uses a certain amount of printing liquid, the amount of printing liquid to be refilled is a minimum. Therefore, it is possible to limit the change in liquid surface position in the droplet ejection portion. The material of the droplet recovery plate 15 can be a metal, a resin, a ceramic, etc., and a through-hole having an internal surface in the shape of a reversed bowl can be formed by a mechanical process such as cutting, press molding, injection molding, etc., or a chemical process such as etching, etc. The internal surface of the droplet recovery plate 15 is processed to be hydrophilic (or lipophilic) so that the ejected droplets not to be used for printing can smoothly return to the printing liquid containing chamber 14. Furthermore, as shown in FIG. 7, a partition wall 71 of a metal or resin, which is molded to be hollow, can be provided inside the through-hole so that even if a printing liquid droplet moving along the internal surface erroneously dripped down, such a droplet would not interfere with the other ejected droplets and the droplet ejection portion. FIG. 8 shows another example of the droplet recovery plate in the case where the head is mounted sideways. In this case, the curved internal wall can be formed only at the lower side of the through-hole, and an angle formed by a surface of the droplet recovery plate 15, which does not contact the printing liquid, and an internal wall at the lower side of the through-hole is an acute angle. Although the internal surface of the through-hole is in a shape of a bowl in FIG. 1, 7, or 8, the shape is not limited thereto but can be in any shape, such as a cone shape or a multi-sided pyramid shape, as long as droplets can return to the printing liquid containing chamber 14 in accordance with the force of gravity. FIG. 9 is still another example of the droplet recovery plate 15 in the case where the head is set so as to face downward. The droplets that are not used for printing transversely move in the drawing to the printing liquid containing chamber. When the head is set to face downward, it is difficult to return the ejected droplets that are not used for printing to the printing liquid containing chamber only by means of gravity, but a pump etc., can be used to return the droplets to the printing liquid containing chamber.

Figure 22:
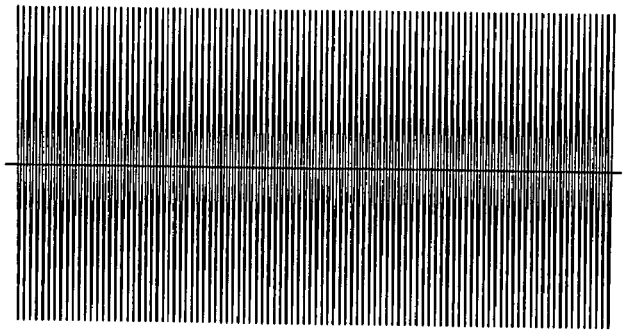
FIG. 22 shows waveform examples of drive signals.
Figure 22:
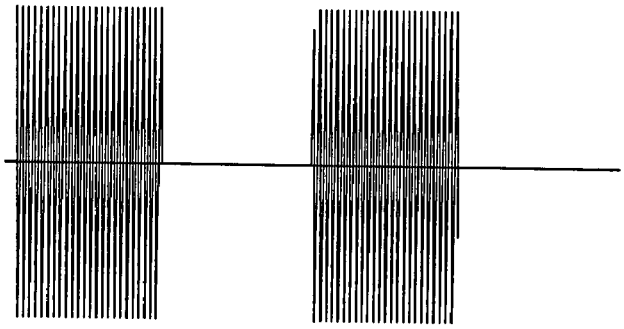
Figure 22:
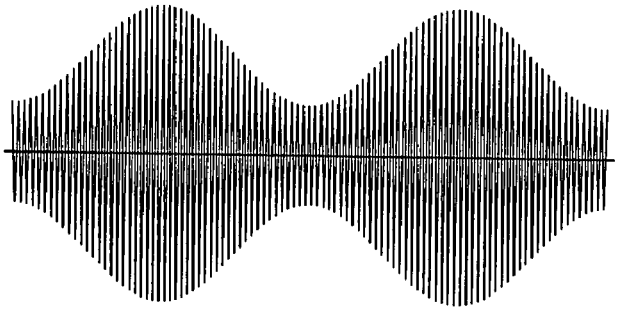
Figure 22:
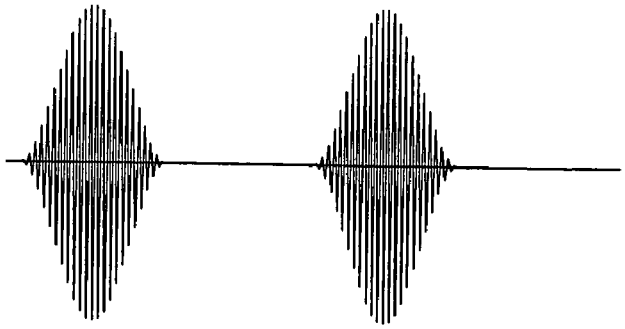

A means for driving the transducers in this embodiment will be described below. The main transducer 11 and the sub transducers 12*a* and 12*b* are connected by wiring to the common drive signal generating source 17. The selector 18 serving as the drive signal control means for determining whether the transducers are driven or not in accordance with image printing data is provided between the sub transducers 12*a* and 12*b* and the drive signal generating source 17. Examples of the drive signals used to continuously eject droplets from the liquid surface are shown in FIG. 22(1)–(4). These signals are burst waves of, e.g., sine waves having a frequency of several tens of MHz. FIG. 22(1) shows continuous waves at a constant voltage, which has a constant frequency depending on a resonant frequency of the transducers; FIG. 22(2) shows tone bursts obtained from FIG. 22(1), i.e., by intermittently forming burst waves having a constant frequency at a constant voltage; FIG. 22(3) shows continuous waves having a constant frequency that are voltage modulated at regular intervals; and FIG. 22(4) shows tone bursts obtained from FIG. 22(3). In order to perform a stable droplet ejection at a higher frequency, the method of intermittently forming burst waves and the method of forming continuous waves that are voltage modulated at regular intervals are preferable.

Figure 10:
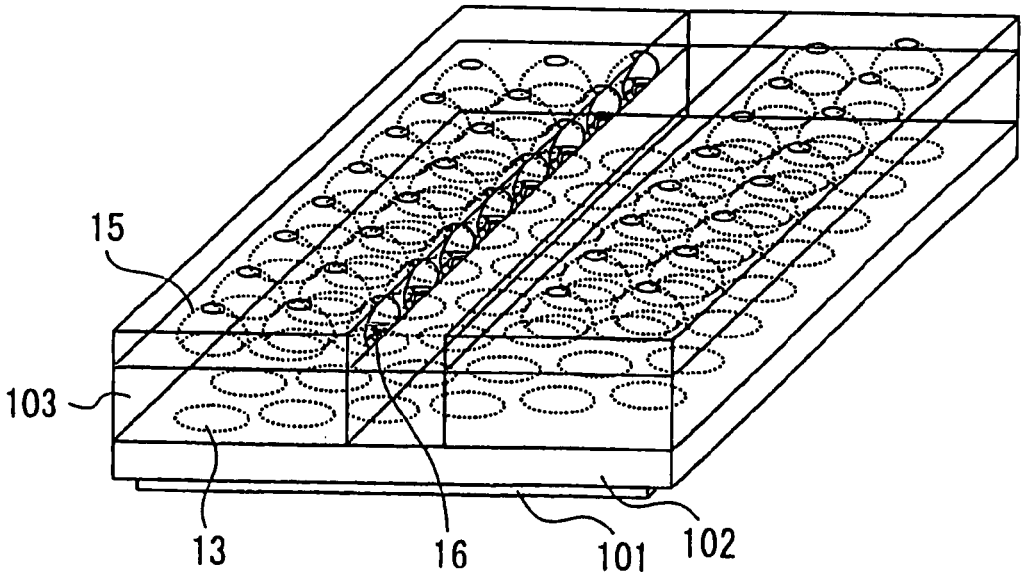
FIG. 10 is a perspective view of an array head of the inkjet printing apparatus according to the first embodiment of the present invention.
Figure 11:
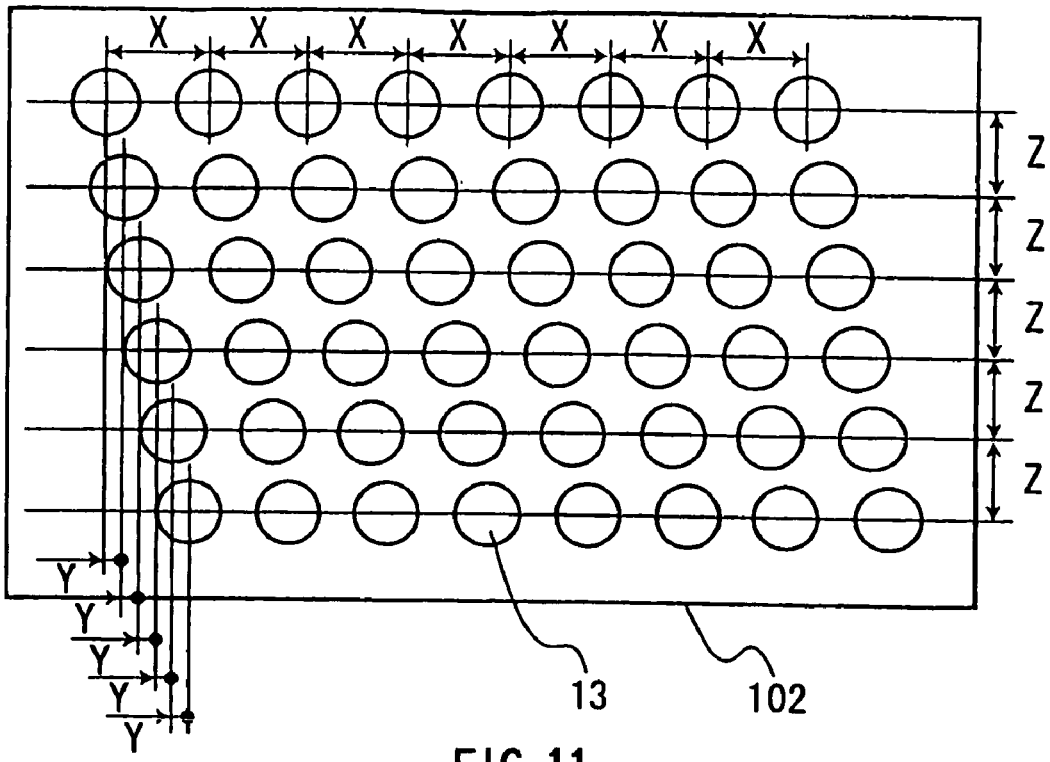
FIG. 11 is a plan view for explaining the arrangement of lenses in the array head of the inkjet printing apparatus according to the first embodiment of the present invention.

FIG. 10 is a perspective view of an array head according to this embodiment. A transducer 101 having a piezoelectric member and electrodes is connected to a lens array substrate 102, on which a printing liquid containing chamber 103 (details thereof not shown), liquid surface control plates 16, and droplet recovery plates 15 are provided. Plano-concave lenses 13 are arranged on the lens array substrate 102 in a manner shown in FIG. 11. That is to say, a certain number of the plano-concave lenses 13 are aligned in an equally-spaced manner with a pitch X, and the lines of the plano-concave lenses 13 are aligned with a pitch Z, with the adjacent two lines being shifted slightly from each other with a pitch Y. In FIG. 11, six lines are sequentially shifted, and the pitch Y is set to be a sixth of the pitch X between the adjacent two lenses. With such a structure, it is possible to realize high-resolution printing in one pass.

Figure 12:
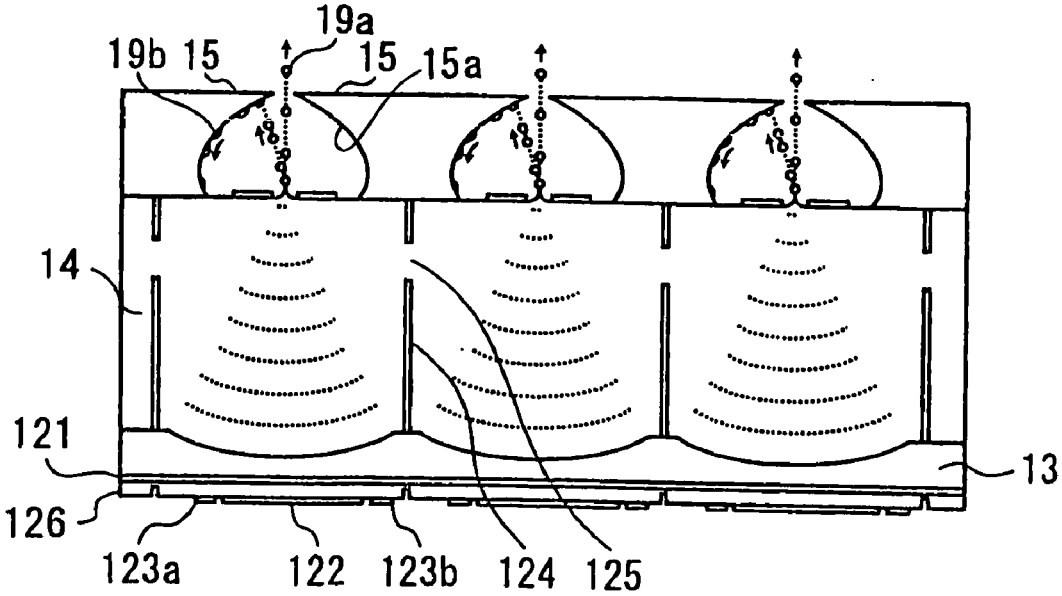
FIG. 12 is a partial sectional view of the array head of the inkjet printing apparatus according to the first embodiment of the present invention.

FIG. 12 shows a sectional view of a part of an array of the inkjet printing apparatus according to this embodiment. The transducers of the array head use a common piezoelectric member 126. Patterned main transducer electrode 122 and sub transducer electrodes 123*a* and 123*b* corresponding to the main transducer and the sub transducers sandwiching the main transducer are formed at a location corresponding to each plano-concave lens. A common electrode 121 is provided to serve as an opposing electrode. Grooves are formed on the piezoelectric member 126 in order to separate each head, i.e., each combination of the main transducer and the two sub transducers sandwiching the main transducer. This is effective to reduce "cross talk" between adjacent combinations. Furthermore, a liquid surface control plate 16 and a corresponding opening of the droplet recovery plate 15 are located immediately above the corresponding concave portion of plano-concave lens 13 serving as the acoustic lens. A partition 124 is formed in the printing liquid containing chamber 14 at a position between adjacent heads, i.e., adjacent combinations of a transducer and two sub transducers sandwiching the transducer, which partition prevents interferences of acoustic waves and convections between adjacent combinations. A partition opening 125 is formed in each partition wall 124, thereby maintaining the flow of printing liquid between the heads.

Next, a specific method for manufacturing a head will be described with reference to FIGS. 10 and 12. A polarized lead titanate piezoelectric ceramic having a thickness of about 0.3 mm is used to form the piezoelectric member 126 of the transducers. A Ti/Au electrode serving as the common electrode 121 is formed on the entire surface of one side of the lead titanate piezoelectric ceramic by sputtering, which is then bonded to the flat portion of the array substrate composed of glass plano-concave lenses 13.

Thereafter, the piezoelectric member 126 is mechanically polished until the thickness thereof becomes 0.05 mm, at which thickness the resonant frequency becomes 50 MHz. Subsequently, a Ti/Au electrode is formed on the entire polished surface by sputtering, and then etched in the pattern of the main transducer electrode 122 and the two sub transducer electrodes 123*a* and 123*b* sandwiching the main transducer 122. Thereafter, a groove with a depth of 0.045 mm is formed in the piezoelectric member 126 for every concave surface (every combination of a main transducer and two sub transducers sandwiching the main transducer) of the plano-concave lenses 13 by means of a dicing blade.

A concave portion of the plano-concave lens array substrate 13 is in an aspheric shape, the spherical aberration of which has been corrected. The material thereof can be Corning #7059, and the total thickness thereof is 1.5 mm. The effective aperture of each lens is 0.45 mm, the focal length is 0.5 mm, and the F-number is about 1. Fifty of the concave portions of the lens array substrate 13 are aligned with a pitch of 0.51 mm, and six of such lines are arranged with a spacing of 0.51 mm, with the starting positions of the lines being shifted by 0.085 mm. In total, the lens array includes 300 concave portions. With such an array structure, it is possible to record at a resolution of 300 dpi in one pass. Next, the printing liquid containing chamber 14 is formed of an injection molded resin, including partition walls 124, and is designed so that a distance between the surface of the lens 13 and the printing liquid surface becomes 0.5 mm, and the liquid surface control plates 16 formed of stainless steel, each of which is etched to be circular, are bonded by an adhesive agent, so that the liquid surface control plates 16 are located above the printing liquid containing chamber 14. Furthermore, the printing liquid recovery plate 15 formed of an injection molded resin is bonded thereon by an adhesive agent, thereby completing the head. The positions of the lens array substrate 13, the printing liquid containing chamber 14, and the liquid surface control plates 16 are determined such that a partition wall 124 of the printing liquid containing chamber 14 is located in each space between adjacent lenses, and the liquid surface control plates 16 are located above the recoding liquid containing chamber 14 so that the center of the droplet ejection region of each liquid surface control plate 16 is located on the central axis of each lens. Similarly, it is preferable that the center of each upper opening of the droplet recovery plate 15 is located on the center axis of each lens. The opening diameter of the upper opening 1 of the liquid surface control plate 16 shown in FIG. 1 is about 0.1 mm, and the opening diameter of the center of the droplet recovery plate 15 is about 0.2 mm. Furthermore, the width A of the main transducer in FIG. 3 is about 0.34 mm, the widths B and C of the two sub transducers are equally about 0.11 mm. The high-frequency driver IC 17 and the selector 18 are connected to such transducers, and an amplitude modulated continuous wave having a frequency of 50 MHz is applied thereto, thereby continuously ejecting droplets having a diameter of about 0.025 mm at a high frequency of 30 kHz. The droplet ejection direction can be changed by about 15 degrees by switching the sub transducers, thereby recovering unnecessary droplets by the droplet recovery plate 15.

(Second Embodiment)

Next, an inkjet printing apparatus according to a second embodiment of the present invention will be described below. With respect to this embodiment, only the features different from those of the first embodiment will be described, and the explanation of the common features will be omitted. Like the first embodiment, the inkjet printing apparatus according to this embodiment aligns phases of ultrasound waves generated. That is to say, a main transducer 11 and a sub transducer 12 are connected to a common drive signal generating source 17, and a concave lens, the spherical aberration of which is corrected, or a Fresnel lens is used as an acoustic lens 13, thereby aligning the phases. When droplet ejection direction is changed in accordance with image printing information, the state of meniscus formed on the liquid surface is not considerably affected. Accordingly, it is possible for the continuous type ultrasound inkjet printing apparatus of this embodiment to stably supply droplets. The difference between this embodiment and the first embodiment lies in that only one sub transducer is provided for operating in accordance with image printing information to deflect the droplet ejection direction.

Figure 13:
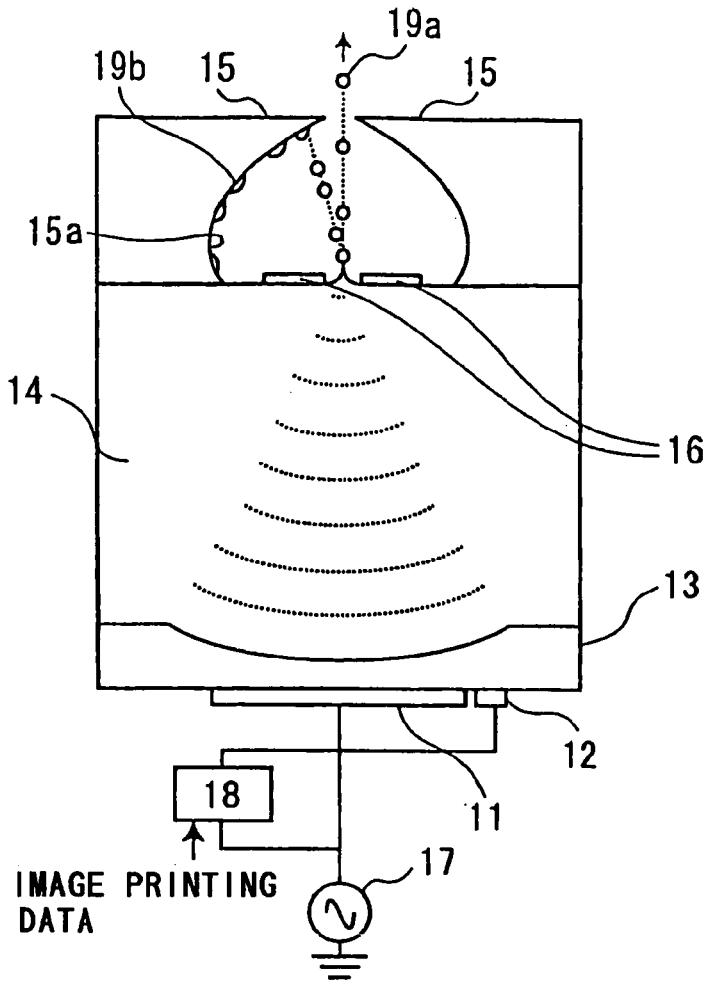
FIG. 13 is a sectional view of a head portion of an inkjet printing apparatus of continuous type according to the second embodiment of the present invention.
Figure 14:
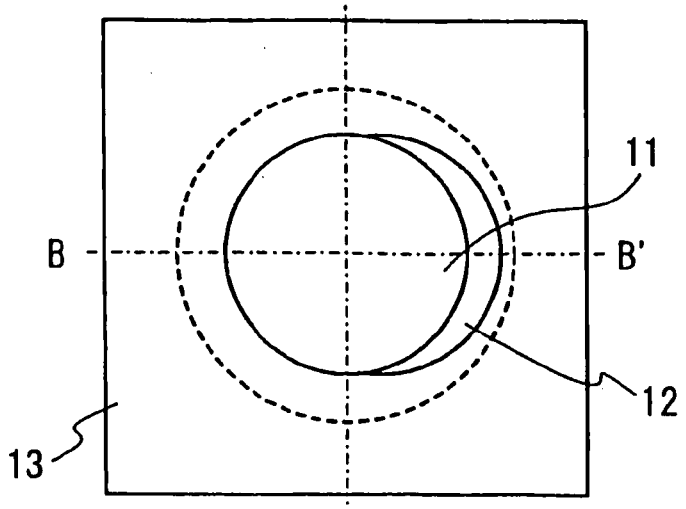
FIG. 14 is a plan view showing the relative location of an acoustic lens and transducers of the inkjet printing apparatus according to the second embodiment of the present invention.
Figure 15:
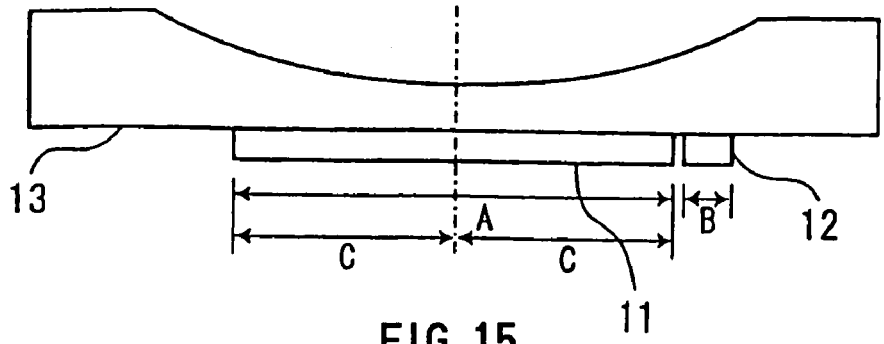
FIG. 15 is a sectional view taken along line B–B' of FIG. 14.

FIG. 13 is a sectional view showing a head portion of the continuous type inkjet printing apparatus according to this embodiment; FIG. 14 is a plan view showing the shapes of the transducers and the locations thereof relative to the acoustic lens; and FIG. 15 is a sectional view taken along line B–B' of FIG. 14.

As shown in FIG. 14, the main transducer 11 is in a circular shape, and located at the center of the acoustic lens 13. The sub transducer 12 is in a crescent shape, and located at one side of the main transducer 11 so as to enfold it. In the first ejection mode, only the main transducer 11 is driven, and the emitted acoustic waves are focused so as to have a symmetrical distribution with respect to the central axis of the acoustic lens 13, thereby ejecting a droplet 19*a* in a direction perpendicular to the surface of the printing liquid contained in a printing liquid containing chamber 14. In the second ejection mode, the main transducer 11 and the sub transducer 12 are simultaneously driven, resulting in that acoustic waves are emitted from a point shifted to the right relative to the central axis of the acoustic lens 13 in FIG. 3. The acoustic waves focused on the liquid surface causes a droplet 19*b* to be ejected in a direction tilted to the left relative to the direction perpendicular to the liquid surface.

In this embodiment, the acoustic pressure of the ultrasound beam at the liquid surface is higher in the second ejection mode than in the first ejection mode, thereby potentially increasing initial speed and diameter of the ejected droplet. However, this is not a serious problem for droplets not used for printing. In order to substantially equalize the droplet ejection states in the first and second ejection modes, it is preferable that the difference in intensity of ultrasound beams between the first and second ejection modes be made about 20% or less, and the acoustic wave emission area of the sub transducer 12 be made a fifth or less of that of the main transducer 11.

Figure 16:
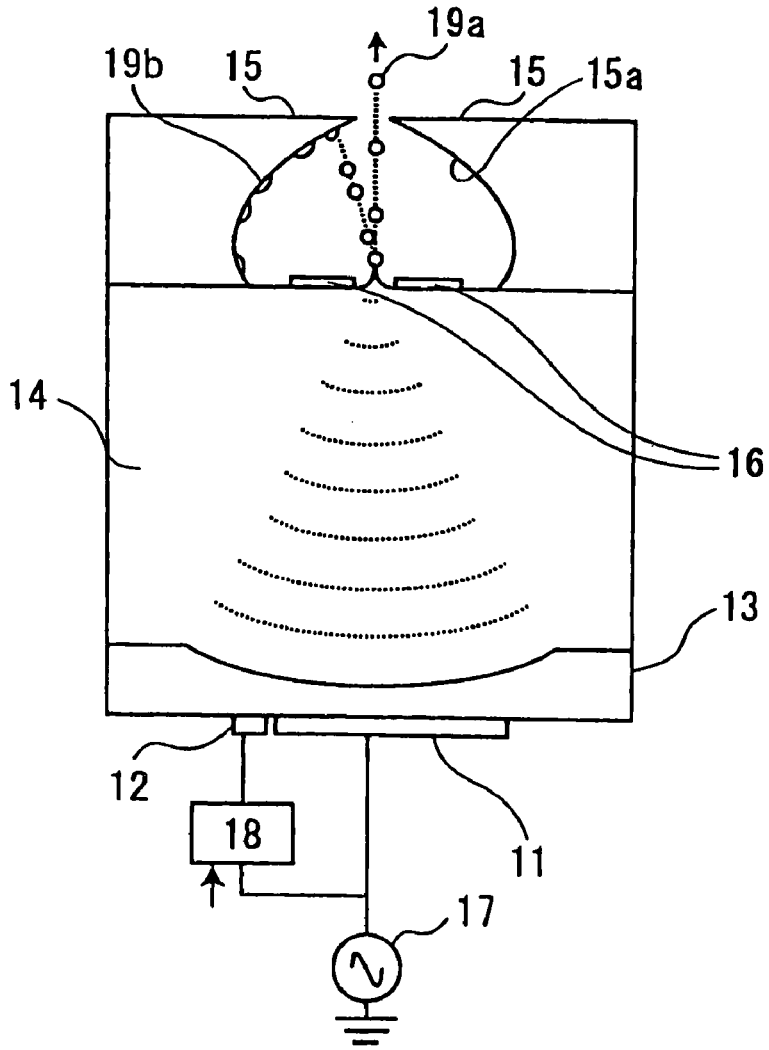
FIG. 16 is a sectional view of a head portion of an inkjet printing apparatus of continuous type according to a modification of the second embodiment of the present invention.
Figure 17:
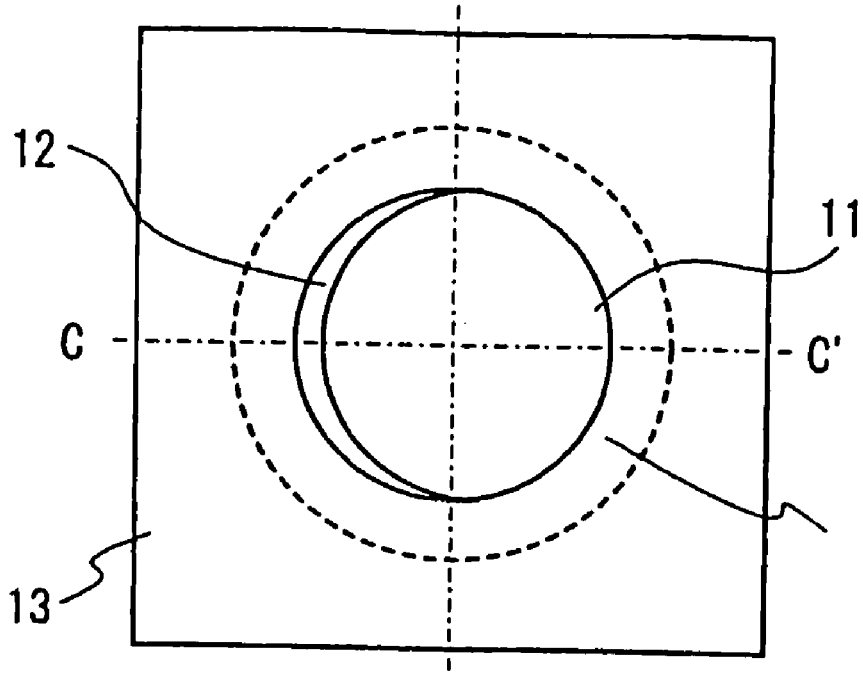
FIG. 17 is a plan view showing the relative location of an acoustic lens and transducers of the inkjet printing apparatus according to the modification of the second embodiment of the present invention.
Figure 18:
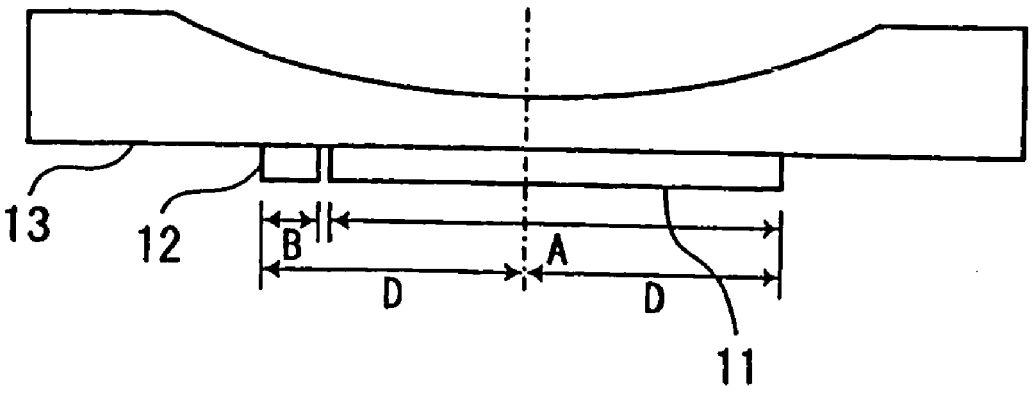
FIG. 18 is a sectional view taken along line C–C' of FIG. 17.

FIG. 16 is a sectional view of a head portion of a continuous type inkjet printing apparatus according to a modification of this embodiment; FIG. 17 is a plan view showing the shapes of the transducers and the locations thereof relative to the acoustic lens; and FIG. 18 is a sectional view taken along line C–C' of FIG. 17.

As in the case of the second embodiment, only one sub transducer is provided for operating in accordance with image printing information to deflect the droplet ejection direction in the modified head structure. However, the locations and shapes thereof are different, i.e., the region including the main transducer 11 and the sub transducer 12 is a circular shape, and located at the center of the acoustic lens 13. In other words, the shape of the main transducer 11 is a circle without a crescent portion. In the first ejection mode, the main transducer 11 and the sub transducer 12 are simultaneously driven, and the emitted acoustic waves are focused so as to have a symmetrical distribution with respect to the center axis of the acoustic lens 13, thereby ejecting a droplet 19*a* in a direction perpendicular to the surface of the printing liquid contained in a printing liquid containing chamber 14. In the second ejection mode, the sub transducer 12 is not driven and only the main transducer 11 is driven, resulting in that acoustic waves are emitted from a point shifted to the right relative to the central axis of the acoustic lens 13 in FIG. 16. The acoustic waves focused on the liquid surface causes a droplet 19*b* to be ejected in a direction tilted to the left relative to the direction perpendicular to the liquid surface.

In this embodiment, the acoustic pressure of the ultrasound beam at the liquid surface is lower in the second ejection mode than in the first ejection mode, thereby potentially decreasing initial speed and diameter of the ejected droplet. However, this has an effect of facilitating the easier recovery of droplets. In order to substantially equalize the droplet ejection states in the first and second ejection modes, it is preferable that the difference in intensity of ultrasound beams between the first and second ejection modes be made about 25% or less, and the acoustic wave emission area of the sub transducer 12 be made a fourth or less of that of the main transducer 11.

As described above, even if only one sub transducer is provided for operating in accordance with image printing information to deflect the droplet ejection direction, as shown in this embodiment and the modification thereof, it is possible to limit the difference in meniscus at the liquid surface between the two ejection modes by aligning phases of vibrations of the main transducer and the sub transducers, resulting in that it is possible to achieve a stable droplet ejection at a high frequency.

(Third Embodiment)

Next, an inkjet printing apparatus according to a third embodiment of the present invention will be described below. With respect to this embodiment, only the features different from those of the first embodiment will be described, and the explanation of the common features will be omitted. Like the first embodiment, the inkjet printing apparatus according to this embodiment aligns phases of ultrasound waves generated. That is to say, a main transducer 11 and a sub transducer 12 are connected to a common drive signal generating source 17, and a concave lens, the spherical aberration of which is corrected, or a Fresnel lens is used as an acoustic lens 13, thereby aligning the phases. When droplet ejection direction is changed in accordance with image printing information, the state of meniscus formed on the liquid surface is not considerably affected. Accordingly, it is possible for the continuous type ultrasound inkjet printing apparatus of this embodiment to stably supply droplets. The difference between this embodiment and the first embodiment lies in that three or more sub transducers are provided for operating in accordance with image printing information to deflect the droplet ejection direction.

Figure 19:
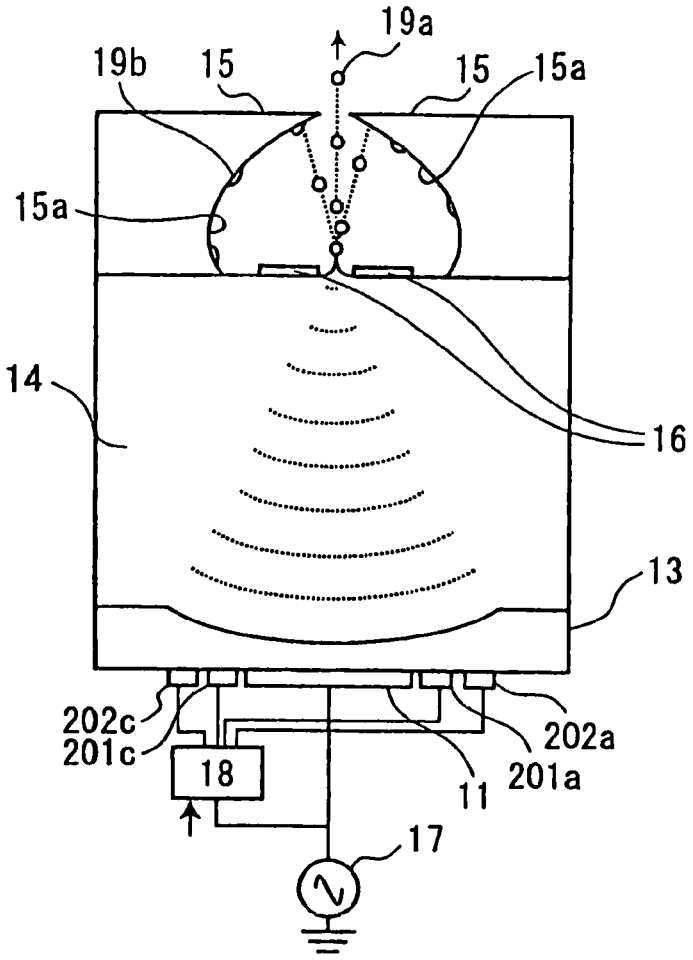
FIG. 19 is a sectional view of a head portion of an inkjet printing apparatus of continuous type according to the third embodiment of the present invention.
Figure 20:
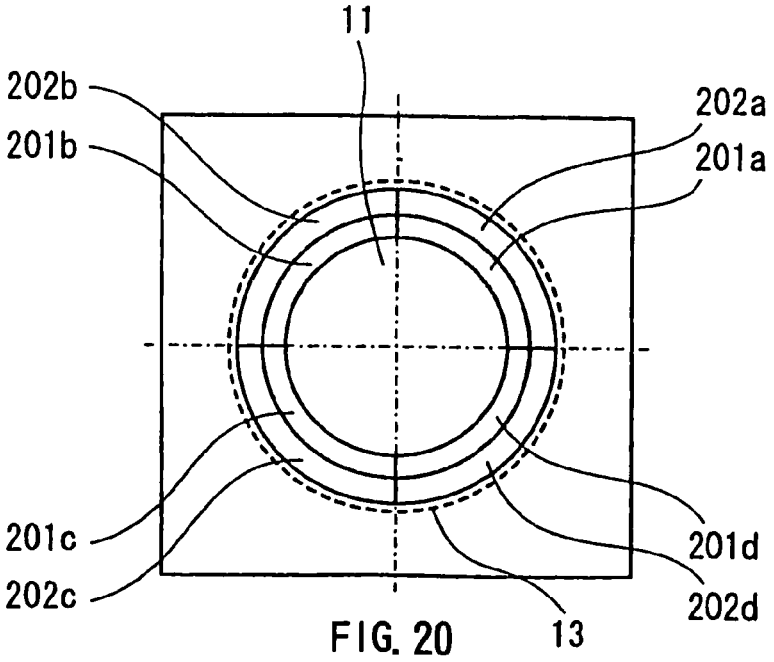
FIG. 20 is a plan view showing the relative location of an acoustic lens and transducers of the inkjet printing apparatus according to the third embodiment of the present invention.

FIG. 19 is a sectional view of a head portion of a continuous type inkjet printing apparatus according to this embodiment; and FIG. 20 is a plan view showing the shapes of the transducers and the locations thereof relative to the acoustic lens.

A circular main transducer 11 is provided at the central portion of the acoustic lens 13. A first group of sub transducers 201*a*, 201*b*, 201*c*, and 201*d* are provided around the main transducer 11, each being in a shape obtained by equally dividing a ring surrounding the main transducer 11 into four parts. Furthermore, a second group of sub transducers 202*a*, 202*b*, 202*c*, and 202*d* are provided around the first group of transducers, each being in a shape obtained by equally dividing a ring surrounding the first sub transducers into four parts.

In the first ejection mode for ejecting a droplet in a direction perpendicular to the surface of a printing liquid contained in a printing liquid containing chamber 14, the main transducer 11 and the first group of sub transducers 201*a*, 201*b*, 201 *c*, and 201*d* are simultaneously driven. In the second mode for ejecting a droplet at an angle with respect to the liquid surface, it is possible to change the ejection direction. For example, a droplet can be ejected diagonally in the direction of the sub transducer 201*b* in the first group by simultaneously driving the main transducer 11, the sub transducers 201*a*, 201*b*, and 201*c* of the first group, and the sub transducer 202*d* of the second group. Similarly, with the combination of the driven transducers being the same as that of the first ejection mode, when the sub transducers 201*b*, 201*c*, 201*d* and 202*a* are driven in the second ejection mode, a droplet can be ejected diagonally in the direction of the sub transducer 201*c*, when the sub transducers 201*a*, 201*c*, 201*d*, and 202*b* are driven, a droplet can be ejected diagonally in the direction of the sub transducer 201*d*, and when the sub transducers 201*a*, 201*b*, 201*d*, and 202*c* are driven, a droplet can be ejected diagonally in the direction of the sub transducer 201*a*. It is possible to select a direction other than these four directions by changing the combination of the sub transducers.

For example, with the combination of the driven transducers being the same as that of the first ejection mode, when the sub transducers 201*c*, 201*d*, 202*a*, and 202*b* are driven in the second ejection mode, it is possible to eject a droplet diagonally in a direction between the directions of the sub transducers 201*c* and 201*d*. Thus, with the arrangement of the sub transducers as shown in FIG. 20, it is possible to switch the ejection direction to one selected from eight or more.

In this embodiment, it is possible to substantially equalize the acoustic pressures of the ultrasound beams at the liquid surface in the first and second ejection modes by substantially equalizing the acoustic wave emission areas of all the sub transducers in the first and second groups. In this way, it is possible to achieve a more stable droplet ejection at a high frequency.

(Fourth Embodiment)

Next, an inkjet printing apparatus according to a fourth embodiment of the present invention will be described below. With respect to this embodiment, only the features different from those of the first embodiment will be described, and the explanation of the common features will be omitted. Like the first embodiment, the inkjet printing apparatus according to this embodiment aligns phases of ultrasound waves generated. That is to say, a main transducer 11 and a sub transducer 12 are connected to a common drive signal generating source 17 and a concave lens, the spherical aberration of which is corrected, or a Fresnel lens is used as an acoustic lens 13, thereby aligning the phases. When droplet ejection direction is changed in accordance with image printing information, the state of meniscus formed on the liquid surface is not considerably affected. Accordingly, it is possible for the continuous type ultrasound inkjet printing apparatus of this embodiment to stably supply droplets. The difference between this embodiment and the first embodiment lies in that an acoustic lens, to which a transducer is bonded, is formed so as to be at an angle with respect to the liquid surface.

Figure 21:
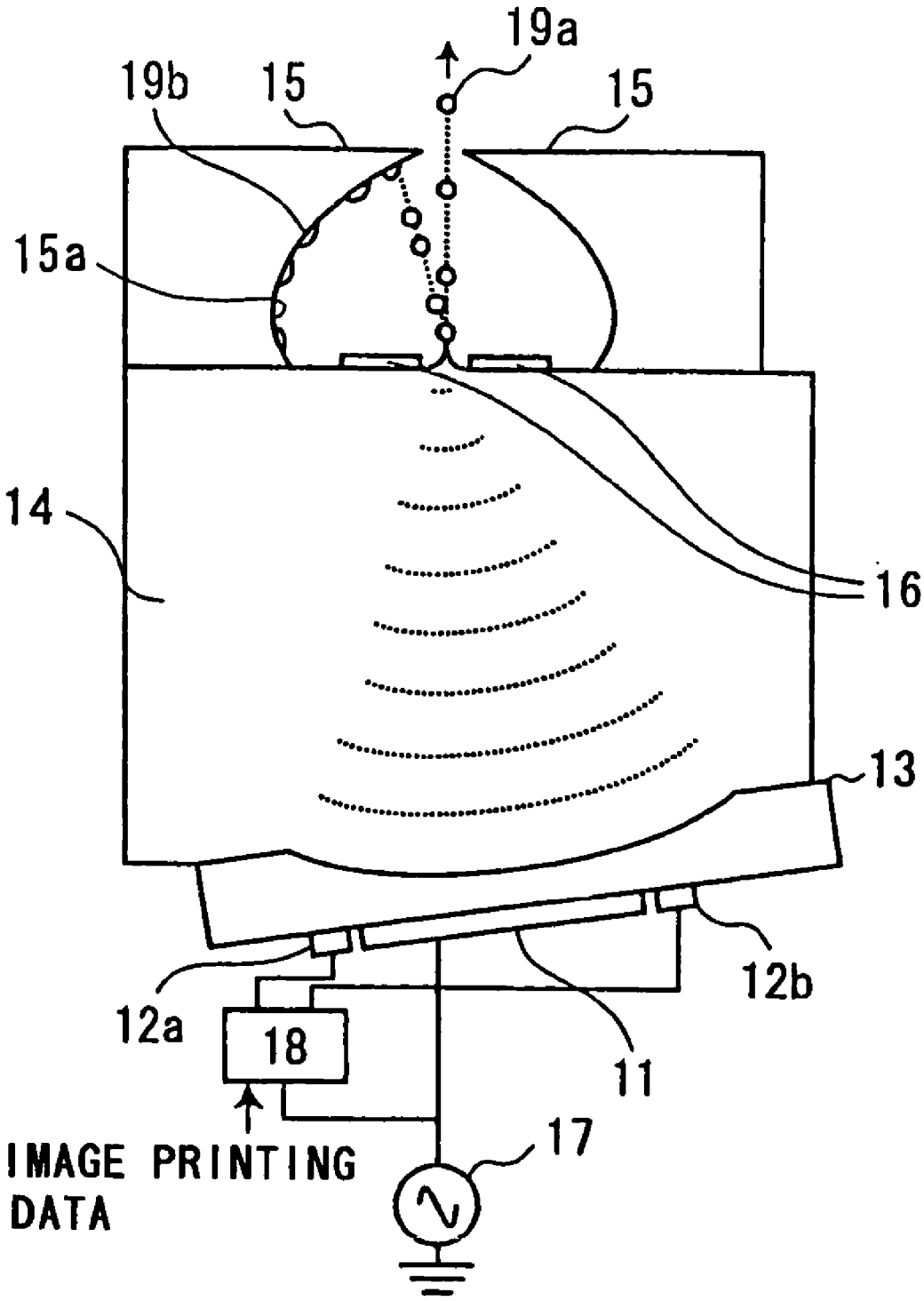
FIG. 21 is a sectional view of a head portion of an inkjet printing apparatus of continuous type according to the fourth embodiment of the present invention.

FIG. 21 is a sectional view of a head portion of a continuous type inkjet printing apparatus according to this embodiment.

As shown in FIG. 21, an acoustic lens 13, and a main transducer 11 and sub transducers 12*a* and 12*b* bonded to the acoustic lens 13 are provided so as to be at an angle with respect to the surface of the printing liquid contained in a printing liquid containing chamber 14. The locations of the transducers relative to the acoustic lens 13 are the reverse of those in the first embodiment shown in FIG. 4. In the first ejection mode for ejecting a droplet in a direction perpendicular to the liquid surface, a combination of the main transducer 11 and the sub transducer 12*a* is driven, and in the second ejection mode for ejecting a droplet at an angle with respect to the liquid surface, a combination of the main transducer 11 and the sub transducer 12*b* is driven. The difference between the first embodiment and this embodiment lies in that the center of the acoustic wave emission region of the combination of the main transducer 11 and the sub transducer 12*a* is shifted from the center of the acoustic lens 13, but the center of the acoustic wave emission region of the combination of the main transducer 11 and the sub transducer 12*b* coincides with the center of the acoustic lens 13. Accordingly, an ultrasound beam, which is at an angle to the central axis of the acoustic lens 13, is used in the first ejection mode, and an ultrasound beam, the distribution of which is symmetrical viewed from the central axis of the acoustic lens, is used in the second ejection mode. Such a structure is suitable for printing an image having a lower printing density, i.e., an image having a lower droplet printing frequency, and it is possible to maintain surely the ejection stability of the second ejection mode, in which droplets are recovered.

It should be noted that the present invention is not limited to the aforementioned embodiments, but other embodiments and a various combinations of such embodiments are possible.

As described above in detail, according to the present invention, it is possible to provide a continuous type inkjet printing apparatus using ultrasound waves, in which the droplet ejection efficiency and the repetitive ejection frequency can be improved, and a highly dense head arrangement of a head can be achieved.

Although ultrasound waves are used in the aforementioned embodiments of the present invention, it is clear that acoustic waves can also be used.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concepts as defined by the appended claims and their equivalents.

What is claimed is:

1. An acoustic inkjet printing apparatus, the acoustic inkjet printing apparatus comprising:

a printing liquid containing chamber containing a printing liquid;

a piezoelectric element including a main transducer and a sub transducer provided on at least one side of the main transducer, the piezoelectric element receiving a drive signal and generating an acoustic wave in response to receiving the drive signal;

an acoustic focusing member focusing the acoustic wave generated by the piezoelectric element near the surface of the printing liquid, thereby ejecting droplets of the printing liquid;

a droplet recovery member provided adjacent to the printing liquid containing chamber, such that the droplet recovery member is in contact with the surface of the printing liquid contained within the printing liquid containing chamber and facing toward the surface of the printing liquid, the droplet recovery member having an opening, through which some of the ejected droplets pass, and a droplet recovery surface facing toward the surface of the printing liquid, such that other ejected droplets that do not pass through the opening hit the droplet recovery surface and are returned to the printing liquid containing chamber; and the acoustic inkjet printing apparatus being capable of switching between a first ejection mode in which the ejected droplets are ejected in a first direction perpendicular to the surface of the printing liquid in the printing liquid containing chamber and a second ejection mode in which the ejected droplets are ejected at an angle to the first direction by applying or not applying a drive signal to the sub transducer in accordance with image printing data, while a drive signal is being applied to the main transducer of the piezoelectric element.

2. The apparatus according to claim 1, wherein the sub transducer is a first sub transducer, the apparatus further comprising a second sub transducer, wherein the second sub transducer is provided on the main transducer opposite to the first sub transducer.

3. The apparatus according to claim 1, wherein the acoustic focusing member is either a concave lens, a spherical aberration of which has been corrected, or a Fresnel lens.

4. The apparatus according to claim 1, wherein the droplet recovery surface is located on at least one side of the opening of the droplet recovery member.

5. The apparatus according to claim 1, wherein the droplet recovery member opening has first and second sides and the droplet recovery surface includes first and second side surfaces, the first and second side surfaces of the droplet recovery surface being provided on the first and second sides of the opening of the droplet recovery member, respectively.

6. The apparatus according to claim 1, wherein the other ejected droplets which hit the droplet recovery surface flow along the droplet recovery surface in accordance with the force of gravity so as to be recovered.

7. The apparatus according to claim 1, wherein centers of the main transducer and the acoustic focusing member are shifted from each other.

8. The apparatus according to claim 1, further comprising a partition wall provided inside the droplet recovery surface, the partition wall preventing the ejected droplets returning to the printing liquid containing chamber from hitting the ejected droplet flying out of the opening.

9. The apparatus according to claim 1, wherein the acoustic focusing member is provided in a manner such that the ejected droplets are ejected in a horizontal direction, and the droplet recovery surface is provided below the opening.

10. The apparatus according to claim 1, wherein the acoustic focusing member is provided in a manner such that the ejected droplets are ejected downward in a vertical direction, and the droplet recovery surface is provided so as to face upward on at least one side of the opening.

11. The apparatus according to claim 1, wherein centers of the main transducer and the acoustic focusing member coincide with each other, and the sub transducer is provided at one side of the main transducer.

12. The apparatus according to claim 1, further comprising additional sub transducers wherein the sub transducer, and the additional sub transducers are provided on the at least one side of the main transducer.

13. The apparatus according to claim 1, wherein the acoustic focusing member is provided in such a manner that the acoustic wave is emitted diagonally relative to a direction of the ejected droplets.

14. The apparatus according to claim 1, wherein the piezoelectric element generates an ultrasound wave.

15. The apparatus according to claim 1, further comprising a drive signal generating circuit generating the drive signal to be applied to the piezoelectric element.

16. The apparatus according to claim 15, wherein the drive signal generating circuit applies the drive signal to the sub transducer in accordance with the image printing data externally applied thereto, while the drive signal is being applied to the main transducer.

17. An acoustic inkjet printing apparatus, the acoustic inkjet printing apparatus including a plurality of printing liquid ejecting units arranged in a matrix form, the units in adjacent lines being shifted from each other, each unit comprising:

a printing liquid containing chamber containing a printing liquid;

a piezoelectric element including a main transducer and a transducer provided on at least one side of the main transducer, and the piezoelectric element receiving a drive signal and generating an ultrasound wave in response to receiving the drive signal;

an acoustic focusing member focusing the acoustic waves generated by the piezoelectric element near the surface of the printing liquid, thereby ejecting droplets of the printing liquid;

a droplet recovery member provided adjacent to the printing liquid containing chamber, such that the droplet recovery member is in contact with the surface of the printing liquid contained within the printing liquid containing chamber and facing toward the surface of the printing liquid, the droplet recovery member having an opening, through which some of the ejected droplets pass, and a droplet recovery surface facing toward the surface of the printing liquid, such that other ejected droplets that do not pass through the opening hit the droplet recovery surface and are returned to the printing liquid containing chamber; and the acoustic inkjet printing apparatus being capable of switching between a first ejection mode in which the ejected droplets are ejected in a first direction perpendicular to the surface of the printing liquid in the printing liquid containing chamber and a second ejection mode in which the ejected droplets are ejected at an angle to the first direction by applying or not applying a drive signal to the sub transducer in accordance with image printing data, while a drive signal is being applied to the main transducer of the piezoelectric element.

18. The apparatus according to claim 17, wherein the piezoelectric element generates an ultrasound wave.

* * * * *